US006105327A

United States Patent [19]

Kroll

[11] Patent Number: 6,105,327

[45] Date of Patent: Aug. 22, 2000

[54] PANEL STRUCTURE

[76] Inventor: Robert C. Kroll, 137 Lombardy La., Orinda, Calif. 94563

[21] Appl. No.: 09/191,158

[22] Filed: Nov. 13, 1998

[51] Int. Cl.[7] ..... E04B 2/02

[52] U.S. Cl. ..... 52/506.05; 52/36.4; 52/506.06; 52/508

[58] Field of Search ..... 52/506.01, 506.05, 52/506.06, 508, 364, 366, 27, 36.4

[56] References Cited

U.S. PATENT DOCUMENTS

| | | | |
|---|---|---|---|
| 2,833,001 | 5/1958 | Montefalco | 52/506.05 |
| 3,362,120 | 1/1968 | Warren | 52/376 |
| 3,628,297 | 12/1971 | Richardson | 52/506.05 |
| 3,803,789 | 4/1974 | Gibson | 52/506.06 |
| 3,881,292 | 5/1975 | Porter | 52/506.05 |
| 5,829,216 | 11/1998 | Newcomb et al. | 52/506.05 |

FOREIGN PATENT DOCUMENTS

| | | | |
|---|---|---|---|
| 151839 | 10/1951 | Australia | 52/506.05 |

*Primary Examiner*—Michael Safavi
*Attorney, Agent, or Firm*—Theodore J. Bielen, Jr.

[57] ABSTRACT

A panel structure attachable to a wall, or ceiling. The panel structure may be used to mount shelf holders and utilizes a first member having first and second sides. The first side of the first member contacts the wall. A shelf standard is included for providing support for shelf holders. A backing member positions to the second side of the first member and to the shelf standard. Fastening of the backing member to the shelf standard and to the first member forms a unit. A second member, generally positioned angularly relative to the first member is positioned adjacent the backing member. Facia elements are fastened to the second member and lie adjacent the shelf standard which extends through the facia element.

10 Claims, 4 Drawing Sheets

PANEL STRUCTURE

BACKGROUND OF THE INVENTION

The present invention relates to a novel and useful panel structure for mounting shelf holders and for covering a ceiling.

The interior of modern edifices are generally covered with plain appearing sheets of material. For example, gypsum board is commonly used throughout the world and is finished with a smooth or stippled texture. The aesthetic appearance of such wall structures is considered to be rather bland and are often decorated with wall hangings and the like.

Panelling has often been used to cover plain wall surfaces to provide a warmer and more appealing ambience. In the past, wooden panel members have been nailed directly to the wall and interlocked through a tongue and groove structure. Although achieving the purpose of covering a typical wall panel, such structures are erected at a great expense of time and energy, translating into a high cost of installation. In addition, such structures are often unsuitable for the latter attachment of shelf standards, which must be accomplished by drilling through the finished panel. The finish appearance of the panel surface is disrupted by this expedient.

A panel structure which is mountable to a wall or ceiling and is capable of supporting shelf holders to a prefabricated structure would be a notable advance in the construction field.

SUMMARY OF THE INVENTION

In accordance with the present invention a novel and useful panel structure for mounting shelf holders and for attachment to a wall is herein provided.

The panel structure of the present invention utilizes a first member having a first side and an opposite second side. The first side of the first member is intended to contact and be attached to a wall. Such attachment may take the form of any known fastening means such as gluing, stapling, nailing, screwing, and the like. Of course, such attachment of the first member is accomplished only after the panel of the present invention is assembled into a unitary structure. The first member may be oriented vertically relative to a wall of an edifice.

A shelf standard is also included in the present invention for providing support for shelf holders. The shelf standard may take the form of a metallic member having a vertical slot with a series of apertures to support the shelf holders or shelf arms. Shelves would then be placed on the arms to hold objects in a dwelling or in a commercial establishment.

A backing member is also found in the panel structure of the present invention. The backing member is positioned to the second side of the first member and to the shelf standard. The backing member may be split into first and second parts, each extending along the length of the shelf standard. First fastening means is provided for uniting the shelf standard, the backing member, and the first member to a unit. In this regard, the first fastening means may take the form of a series of fasteners which are capable of penetrating each of these elements.

A second member is also included in the present invention and is positioned adjacent the backing member and outwardly from the first side of the first member. That is to say, the second member is positioned closer to the second side of the first member than to the first side of the first member. The second member extends outwardly from the unit which includes the shelf standard. In general, the second members angularly oriented relative to the first member. Second fastening means connects the second member to the first member to achieve greater strength of the panel structure of the present invention. Multiple second members spaced parallel to one another may be employed in the panel of the present application.

A plurality of facia elements, or slats, are mounted to the second member, or members, and lie adjacent to the shelf standard which extends outwardly from the backing member. The plurality of facia elements allow access to the slot of the shelf standard in order to permit the shelf arms to extend outwardly from the facia elements. Facia elements may be interlocking members and provide a gap between one another for aesthetic appeal. The panel units of the present invention may be connected to a wall structure quickly and easily, once they are assembled.

In addition, the panel structure of the present invention includes a ceiling attachment embodiment. In the ceiling attachment embodiment of the panel structure of the present invention, a plurality of backing members are spaced from one another. A series of facia members, or slats, are placed between the plurality of backing members with each succeeding facia member being connected to one less of the plurality of backing members, until a final facia member connects only to one backing member. That is to say, a first facia member connects to only one of the spaced backing members. An adjacent second facia member extends between and connects to only two of the spaced backing members. Finally, a third facia member may be employed and be positioned adjacent the second facia member. The third facia member extends between and connects to only three of the spaced backing members. The structure allows interlocking of adjacent panel members with the voids in each panel being filled by facia members of a particular size to complete the structure.

It may be apparent that a novel and useful panel structure for mounting shelf holders against a wall or for covering a ceiling is herein provided.

It is therefore an object of the present invention to provide a panel structure which is easy and simple to prefabricate and integrates the support of a shelving standard for later use in supporting shelves along a wall.

Another object of the present invention is to provide a panel structure for mounting shelf holders which utilizes a minimum amount of material and permits the fastening of the panel structure to a wall easily without marring the facia members.

A further object of the present invention is to provide a panel structure which reduces the expense of paneling a wall on an edifice.

A further object of the present invention is to provide a panel structure which may be preassembled for use on a ceiling and is useable with like panel structures and additional facia units.

Yet another object of the present invention is to provide a panel structure for covering a ceiling which is easily manufactured and assembled with a minimum expenditure of labor time.

The invention possesses other objects and advantages especially as concerns particular characteristics and features thereof which will become apparent as the specification continues.

For a better understanding of the invention references made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments thereof which should be referenced to the prior described drawings.

Figure 1:
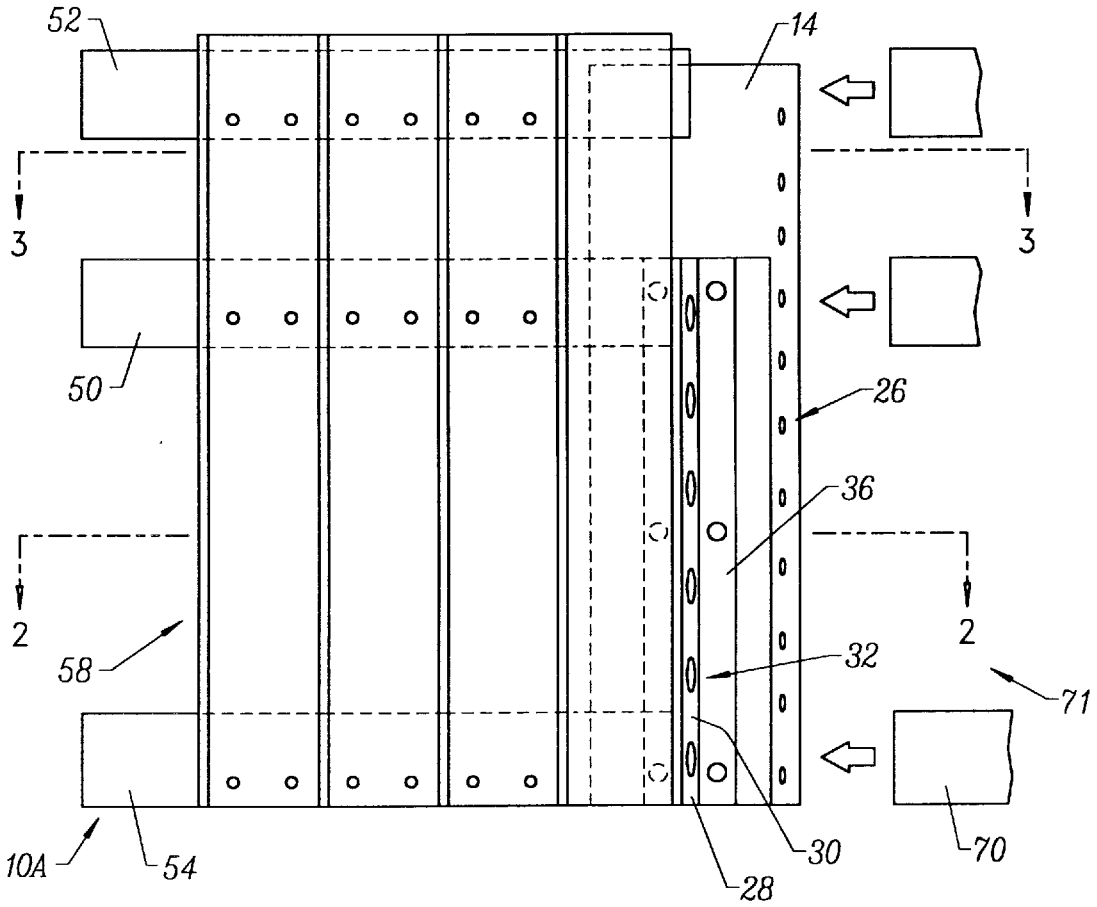
FIG. 1 is a front elevational view of the panel structure of the present invention intending for being mounted to a wall.
Figure 2:
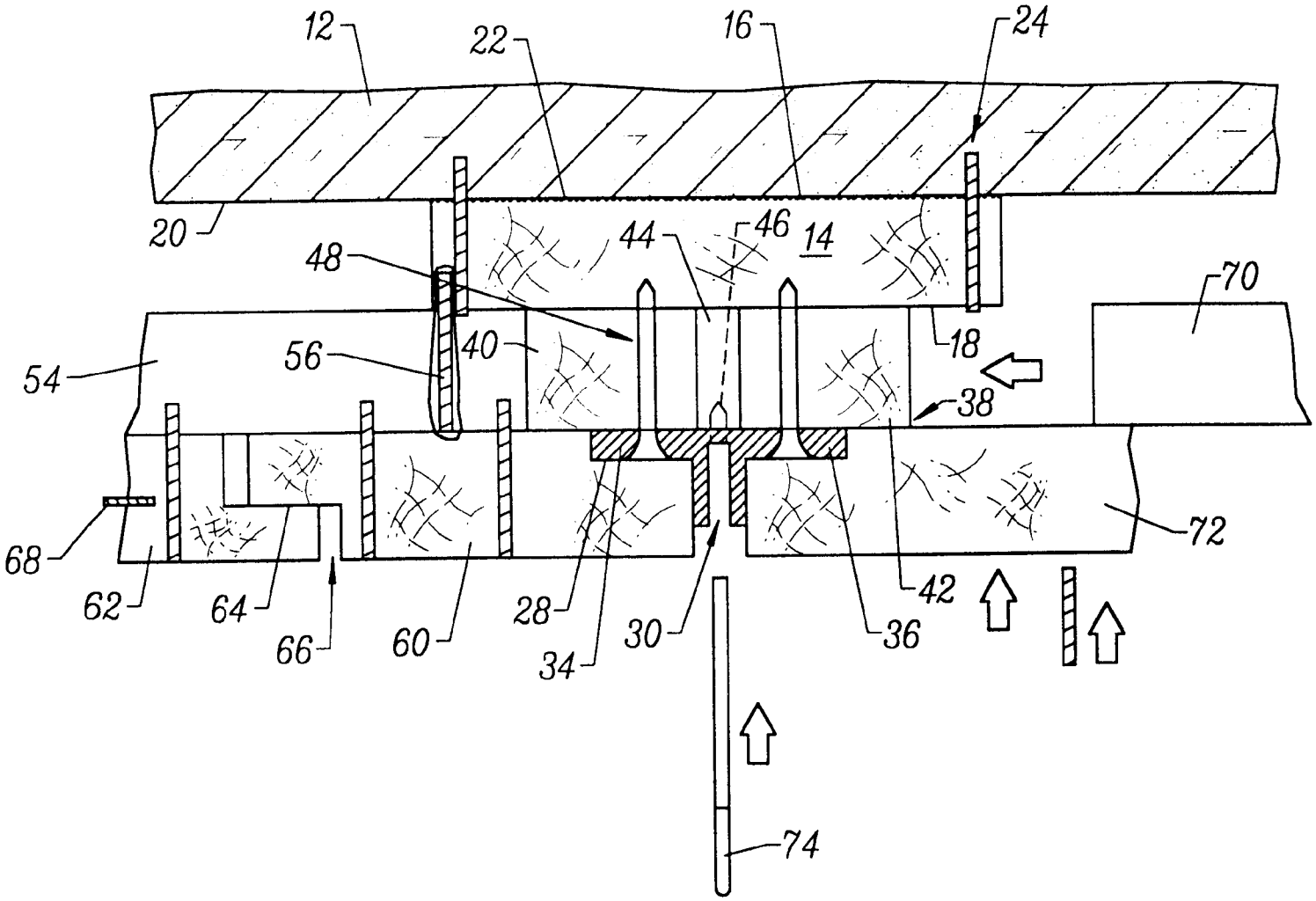
FIG. 2 is a sectional view taken along line 2—2 of FIG. 1.

The invention as a whole is shown in the drawings by reference character 10, followed by an uppercase letter to distinguish embodiments of the same. FIG. 1 illustrates panel structure 10A which is intended to be fastened to a wall 12, depicted in FIG. 2. Panel 10A includes as one of its elements a first member 14 which includes a first side 16 and an opposite second side 18. First side 16 is intended to contact the outer surface 20 of wall 12. As is depicted in FIG. 2, such attachment may take the form of a mastic or glue layer 22, as well as plurality of fasteners 24. Of course, any known fastening means may be employed in this regard. First member 14 extends the height of panel structure 10A as is shown in FIG. 1. A plurality of fasteners or staples 26 including fasteners 24, are illustrated thereon.

Also found in panel structure 10A is a shelf standard 28. Shelf standard 28 is generally a metallic member having an elongated slot 30 with a plurality of apertures 32 for the acceptance of shelf arms or supports (not shown in FIGS. 1 and 2). Shelf standard 28 also includes wings or flanges 34 and 36 adjacent slot 30, which also extend the length of standard 28.

Backing member 38, FIG. 2, is placed between first member 14 and shelf standard 28. As is depicted in FIG. 2, backing member 38 includes a first part 40 and a second part 42, with a hiatus 44 between parts 40 and 42. Hiatus 44 permits a portion 46 of a shelf arm support 74 to extend thereunto, depicted in phantom in FIG. 2. First fastening means 48 unites first member 14, backing member 38, and shelf standard 28 into a unit.

At least one second member 50 is employed with the panel structure 10A of the present invention. FIG. 1 illustrates that a trio of second members, 50, 52, and 54 are depicted in this regard. Second fastening means 56 connects second members 50, 52, and 54 to first member 14. As may be seen in FIG. 1, second members 50, 52, and 54 extend angularly or laterally relative to first member 14.

A plurality of facia elements or slats 58 are also utilized in the present invention. Turning to FIG. 2, it may be seen that facia elements 60 and 62 are shown and include a lap joint 64. A gap 66 appears on the front of panel structure 10A between each of the plurality of facia elements for the sake of aesthetics. Multiplicity of fasteners 68 mount facia elements 58 to second members 50, 52, and 54. It should be noted that facia element 60 lies immediately adjacent shelf standard 28 and atop wing 34 thereof. With reference to FIG. 2, it may be seen that the second element 70 of an adjacent panel 71 is illustrated and is intended to fit adjacent second part 42 of backing member 38. Also, portion of a facia member 72 is illustrated which would cover the exposed wing 36, backing member 42, and the front surface of second member 70 of adjacent panel 71.

Figure 3:
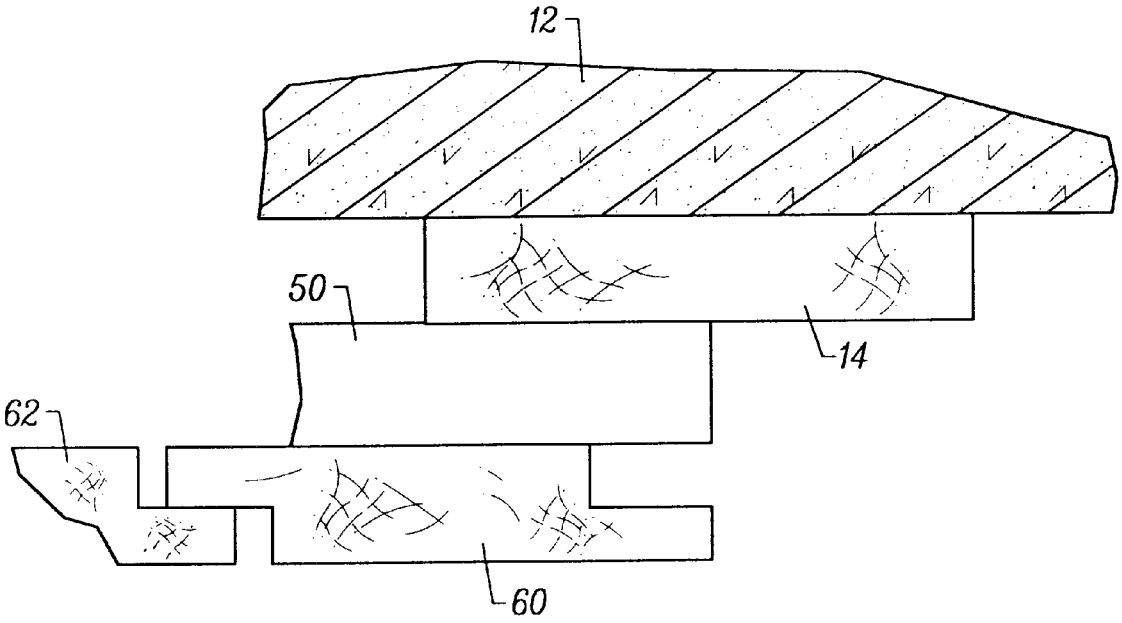
FIG. 3 is a sectional view taken along line 3—3 of FIG. 1.

FIG. 3 illustrates a portion of panel structure 10A which lies above shelf standard 28. The fastening means employed with respect to the panel depicted in FIG. 2, the shelf standard 28, and backing member 38 has been omitted from FIG. 3 for the sake of clarity.

Figure 4:
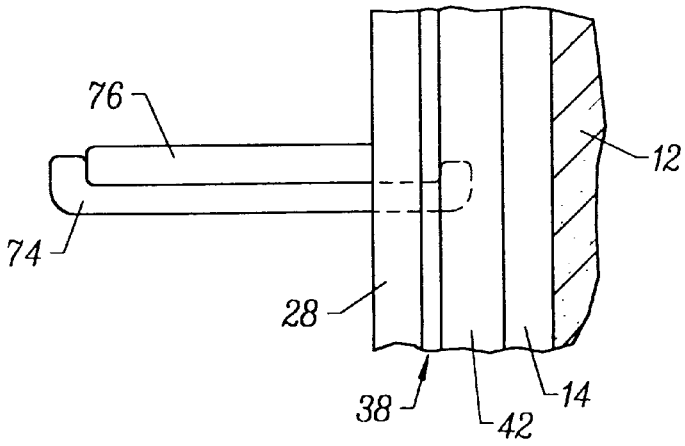
FIG. 4 is a partial right side elevational view of FIG. 1 with the addition of a shelf arm or support holding a shelf in place.

FIG. 4 illustrates a shelf support or arm 74 which is used in conjunction with shelf standard 28. A typical shelf 76 is illustrated as being supported by shelf arm 74. It should be understood, that any one of plurality of apertures 32 may be employed with shelf arms or supports such as shelf support or arm 74.

Figure 5:
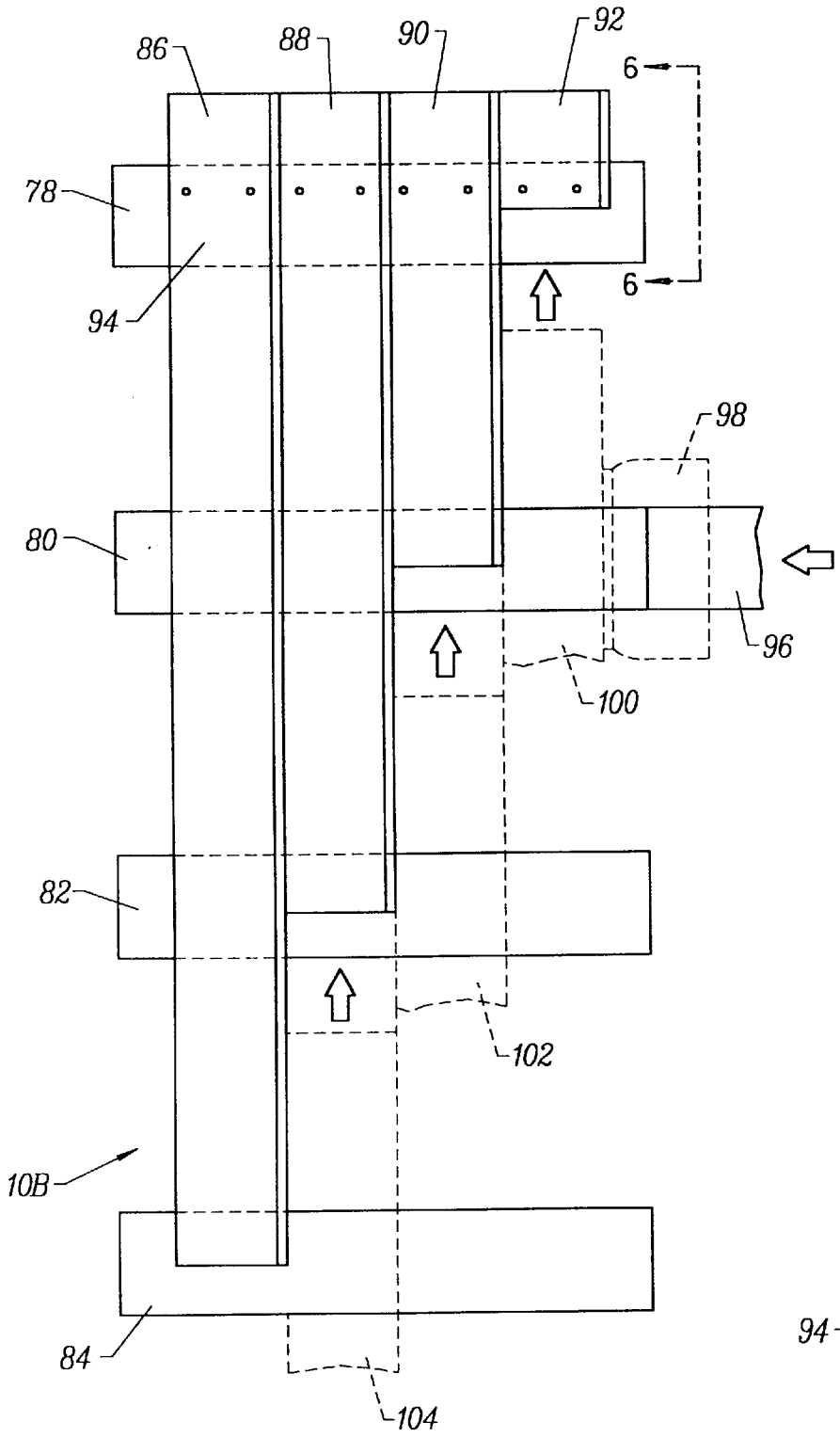
FIG. 5 is a front elevational view of the panel structure employed in covering a ceiling.
Figure 6:
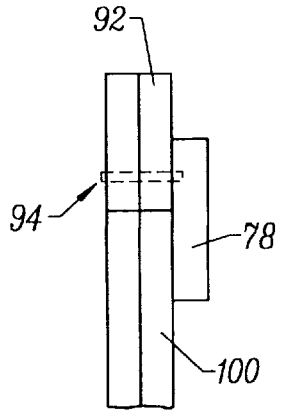
FIG. 6 is a right side elevational view taken along line 6—6 of FIG. 5.

With reference to FIG. 5, the embodiment 10B of the panel structure of the present invention is shown. Panel 10B is intended to cover a ceiling rather than a wall. Panel structure 10B includes backing members 78, 80, 82, and 84 which are spaced from one another in generally parallel configuration. Facia members 86, 88, 90, and 92 are fastened to backing members 78, 80, 82, and 84 by any known fastening means. Plurality of finishing nails 94 are illustrated with respect to backing member 78, in this regard. It may be realized by viewing FIG. 5, facia member 86 is the longest and is connected to each of the backing members 78, 80, 82, and 84. Succeeding facia members 88, 90, and 92 connect to one less backing member as the facia members progress from left to right on FIG. 5. Consequently, facia member 92 only connects to backing member 78. Backing members 78, 80, 82, and 84 have exposed ends which measure approximately half the width of each of the facia members 86, 88, 90, and 92. This permits another like panel, illustrated schematically by backing member 96, to be placed adjacent the backing members 78, 80, 82, and 84 of panel 10B. Also, a typical facia member such as facia member 98, depicted in phantom on FIG. 5, may be employed to fill the gap between adjacent panel members. Further, facia members 100, 102, and 104 are used to fill in the space left when two panels identical to panel 10B are placed side-by-side FIGS. 5 and 6.

In operation, the user assembles panel 10A by employing a first member 14, backing member 38, and shelf standard 28. Second fastening means 56 is used to combined these elements into a unit. Second members 50, 52, and 54 are extended laterally from and connected to first member 14. Facia members or elements 58 are then fastened to second members 50, 52, and 54, leaving slot 30 of shelf standard 28 exposed to accept shelf arms, such as shelf arm 74, FIGS. 2 and 4. Identical panels of like configuration may be placed side-by-side to complete the covering of a wall 12. Fasteners 24 and glue or mastic layer 22 may be employed on first side 16 of member 14, in this regard. With respect to embodiment 10B, backing members 78, 80, 82, and 84 are spaced from one another in relative parallel configuration. Facia members or slats 86, 88, 90, and 92 of decreasing length are fastened to the backing members as depicted in FIG. 5. An adjacent panel of like configuration may be placed side-by-side with panel 10B. Additional facia members, such as facia members 98, 100, 102, and 104, may be employed to fill the gaps formed between the adjacent panel structures 10B.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A panel structure attachable to a wall and for mounting shelf holders, comprising;

a. a first member having a first side and an opposite second side, said first side intended for attachment to the wall;

b. a shelf standard intended for providing support for shelf holders;

c. a backing member positioned adjacent said second side of said first member and supporting said shelf standard;

d. first fastening means for uniting said shelf standard, said backing member, and said first member into a unit;

e. a second member positioned adjacent said backing member;

f. second fastening means for connecting said second member to said first member; and g. a plurality of facia elements mounted to said second member and lying adjacent said shelf standard, a pair of said plurality of said facia elements forming a gap therebetween permitting access to said shelf standard.

2. The structure of claim 1 in which said second member is positioned closer to said second side of said first member than said first side of said first member.

3. The structure of claim 2 in which said second member is angularly oriented relative to said first member.

4. The structure of claim 3 in which each of said plurality of facia elements are spaced from one another to form a multiplicity of gaps.

5. The structure of claim 4 in which said first fastening means includes a plurality of fasteners each penetrating said shelf standard, said backing member and said first member.

6. The structure of claim 1 in which said backing member includes a first part and a second part spaced from said first part forming a hiatus therebetween.

7. The structure of claim 6 in which said second member is positioned closer to said second side of said first member than said first side of said first member.

8. The structure of claim 7 in which said second member is angularly oriented relative to said first member.

9. The structure of claim 8 in which each of said plurality of facia elements are spaced from one another to form a multiplicity of gaps.

10. The structure of claim 9 in which said first fastening means includes a plurality of fasteners each penetrating said shelf standard, said backing member and said first member.

* * * * *